US005918766A

United States Patent [19]

Osborne

[11] Patent Number: 5,918,766

[45] Date of Patent: Jul. 6, 1999

[54] LOCKING FORECOURT FUEL PUMP

[76] Inventor: Graham William Osborne, 74 Yarmouth Rd, North Walsham, United Kingdom, NR28 9AU

[21] Appl. No.: 08/894,176

[22] PCT Filed: Feb. 16, 1996

[86] PCT No.: PCT/GB96/00369

§ 371 Date: Aug. 13, 1997

§ 102(e) Date: Aug. 13, 1997

[87] PCT Pub. No.: WO96/26155

PCT Pub. Date: Aug. 29, 1996

[30] Foreign Application Priority Data

Feb. 18, 1995 [GB] United Kingdom ..... 9503186

[51] Int. Cl.[6] ..... B67D 5/12; B67D 5/33

[52] U.S. Cl. ..... 222/74; 222/75; 222/153.03

[58] Field of Search ..... 222/74, 75, 153.03

[56] References Cited

U.S. PATENT DOCUMENTS

| | | | |
|---|---|---|---|
| 2,665,032 | 1/1954 | Foss et al. | 222/74 |
| 2,668,680 | 2/1954 | Moser | 222/74 |
| 3,178,057 | 4/1965 | Nelson | 222/74 |
| 3,510,630 | 5/1970 | Ryan et al. | 222/153.03 |
| 3,705,400 | 12/1972 | Cordes, Jr. | 340/347 R |
| 3,774,227 | 11/1973 | Smilgys | 222/153.03 |
| 4,186,850 | 2/1980 | Mahar | 222/74 |
| 4,248,335 | 2/1981 | Cornelius et al. | 222/153.03 |
| 4,367,827 | 1/1983 | Keller et al. | 222/2 |
| 5,038,061 | 8/1991 | Olsen | 310/15 |
| 5,110,010 | 5/1992 | Smith | 222/75 |
| 5,417,805 | 5/1995 | Rosenblad | 159/13.1 |

*Primary Examiner*—Andres Kashnikow
*Assistant Examiner*—Keats Quinalty
*Attorney, Agent, or Firm*—Andrus, Sceales, Starke & Sawall

[57] ABSTRACT

A locking arrangement for a forecourt fuel pump having a nozzle (11) receivable in a holder (13) of the pump body has a bar (23) movable between free and locked positions by an actuator (28). When the bar (23) is in its locked position, the bar passes through an opening (24) in the nozzle handle, so preventing removal of the nozzle from its holder. The actuator (28) may be electrically controlled from a remote position such as a payment booth. All of the fuel pumps on a forecourt may similarly be arranged to permit simultaneous locking and unlocking of all of the pump nozzles.

16 Claims, 3 Drawing Sheets

LOCKING FORECOURT FUEL PUMP

This invention relates to a forecourt fuel pump. The invention further relates to a forecourt layout including at least one such fuel pump.

A typical garage or filling station forecourt fuel pump has a body secured to the ground and containing pumping and metering equipment. Delivery of metered fuel is through a flexible hose having, at its free end, a delivery nozzle including a manually operable delivery valve. When not in use, the nozzle is stored in a holder provided in the pump body, which holder has a detector for the presence or otherwise of the nozzle, whereby the pump motor may automatically be switched on whenever the nozzle is removed from its holder. With a forecourt fuel pump of the kind described above, the metering equipment may automatically be re-set to zero each time a nozzle is removed from its holder. More recently, and particularly with the advent with self-service filling stations, it has been the practice to provide a remote re-setting arrangement, whereby fuel delivery may start only once an operator has remotely caused the re-setting of the metering equipment and display device.

When a filling station is to close temporarily (for example over-night), it is most desirable that each fuel pump delivery pipe nozzle is firmly secured in its associated holder. This is not only to prevent vandalism, but perhaps more importantly also to prevent possible fraudulent abstraction of fuel. Conventionally, a typical forecourt fuel pump nozzle includes an opening which, when the nozzle is in its holder, is in general alignment with a similar opening on the frame of the pump body, whereby a padlock may be passed through the aligned openings and secured in position, thereby to lock the nozzle in its holder. When the filling station is to re-open once more, all of the padlocks must individually be removed, and taken back to a suitable storage site. This locking and unlocking procedure using padlocks is very time consuming and possibly also somewhat irritating for the operator, especially if each padlock requires the use of an individual key. Moreover, there is some risk to the operator, especially as both the locking and unlocking operations are often performed during unsocial hours, when the area may largely be deserted.

Some fuel pumps incorporate a so-called barrel lock, which is built into the frame of the pump and performs essentially the same function as a padlock, as described above. Though an operator does not have to carry the lock with him, nevertheless the barrel lock still suffers from the same disadvantages as described above.

The present invention aims at reducing the above-mentioned disadvantages associated with the securing of the nozzle of a fuel pump to the fuel pump body, when a filling station is to close, and releasing the nozzle when the filling station is to re-open for business, once more.

According to the present invention, there is provided a forecourt fuel pump including a flexible delivery hose having a delivery nozzle at its free end and a holder for the nozzle, which pump further includes a locking member mounted on the pump and movable between a locked position where the locking member is engaged with the nozzle when in its holder and prevents the nozzle being removed from therefrom and a free position where the nozzle is free of the locking member, power-operated actuator for moving the locking member between its two positions, and control means for the power-operated actuator.

It will be appreciated that with a fuel pump of the present invention, there is no need to use an individual padlock, for each nozzle to be locked in its associated holder. Instead, the control means may be operated to cause the actuator to move a locking member to secure a nozzle in its holder, at the close of business, and then to release the locking member when the station is to re-open once more. The control means could operate hydraulically or pneumatically, but preferably operates electrically. Such control means advantageously includes switch means disposed at a location remote from the pump being controlled: an operator then does not have to visit each pump of a filling station in order to effect the locking and unlocking. Rather, the switch means may be located for example within a payment booth or other protected area, whereby the locking may easily and very quickly be performed. Equally, the unlocking may also be performed in an easy and quick manner.

Many modern forecourt fuel pumps incorporate a microprocessor to perform various functions associated with the delivery of fuel. The electrical control means for the actuator may be linked to such a microprocessor, in order that the locking and unlocking of the pump may be effected under the control of that microprocessor. For example, the microprocessor may be programmed to effect locking and unlocking at pre-set times of the day. Other possibilities include automatic locking in the event that the storage tank from which the pump draws fuel is empty, or if the pump has a credit card payment facility, to maintain the nozzle locked until a credit card has been inserted into the card reader, and the transaction authorized.

The locking member may comprise a bar which, when in its locked position, extends through a suitable aperture in the nozzle. Though that aperture could be the one which conventionally is used for receiving a padlock, it is preferred for the locking member to be received in a hand-hold aperture of the nozzle. This allows the use of a relatively large locking member and also obviates the need for accurate alignment between the opening in the nozzle and another opening on the pump body. Moreover, it still allows conventional locking using a padlock, should that be required.

The locking member could slide generally linearly, between its two positions. It is however preferred for the locking member to be in the form of an arm mounted for rotational movement between its free and locked positions. Either way, the actuator preferably resists movement of the locking member when the locking member is to be driven by the actuator. This prevents unauthorized movement of the locking member by applying force directly thereto, with a suitable tool inserted into the nozzle holder of the pump.

The actuator may comprise an electro-magnetic device such as a solenoid, coupled to the locking member by a link. Alternatively, the actuator may comprise a motor having a rotary output appropriately coupled to the locking member, for example by means of a screw-threaded arrangement.

It will be appreciated that the present invention is equally applicable to a fuel pump having a single delivery hose and nozzle, and to a pump having two or even several delivery hoses and nozzles. In the latter case, a single actuator may be coupled to individual locking members associated one with each holder, whereby all of the nozzles may be locked in position at the same time, by the single actuator.

The control means may include a monitoring arrangement, to determine whether the locking member has properly moved when an appropriate control signal has issued. In this way, should a nozzle not be located properly in its nozzle holder, so making locking of the nozzle not possible because movement of the locking member is blocked, an appropriate warning may be issued to an operator. Also the control means may include an inhibiting arrangement coupled to a nozzle-detection switch associated with the holder, whereby operation of the actuator will be inhibited until the nozzle has been detected as being positioned within its holder. In this way, movement of the locking member to its locked position will be prevented until the nozzle has properly been stowed in its holder.

This invention extends to a forecourt layout including a plurality of petrol pumps of this invention as described above, wherein the control means includes a switch arrangement to cause essentially simultaneous operation of the power-operated actuators of all of the pumps, to move all of the locking members of the pumps either to their respective free positions or to their respective locked positions. In this way, one operator may effect essentially simultaneously locking or unlocking of all of the nozzles of all of the fuel pumps on the forecourt, merely by operating a single switch, which conveniently is located remotely of the pumps—for example in a cashier's booth.

By way of example only, one specific embodiment of the present invention will now be described in detail, reference being made to the accompanying drawings, in which:

FIG. 1 diagrammatically shows an end view on a petrol pump;

Figure 1:
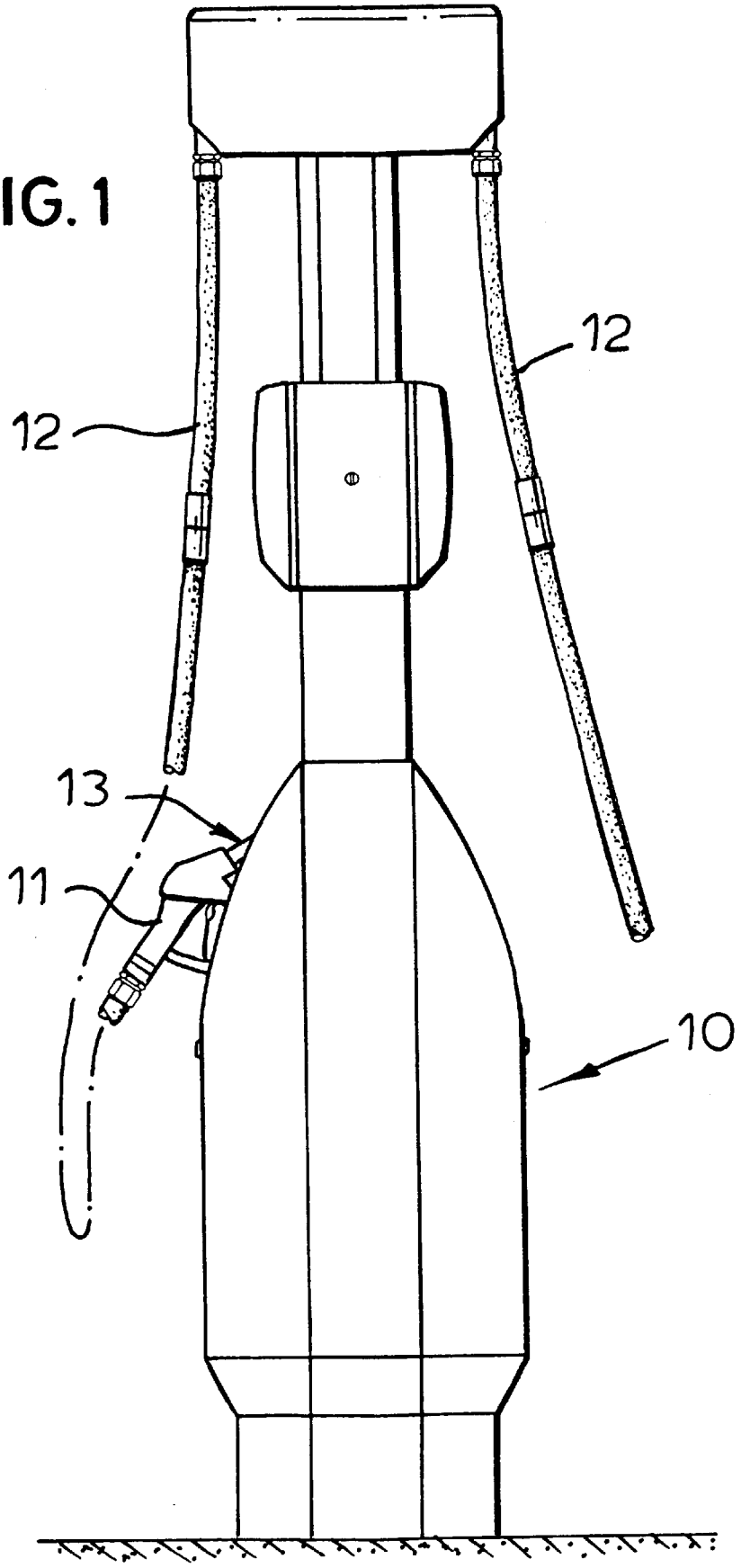

The pump 10 shown in the drawings is arranged to deliver two different grades of fuel, through four delivery nozzles 11 and associated flexible hoses 12, arranged two on each side of the pump. Each nozzle 11 has an associated nozzle holder 13 in the pump body, where the respective nozzle is stowed when not in use for delivering fuel. Thus, there are two nozzle holders 13 arranged closely adjacent one another on each of the two sides of the pump 10, in order that all four nozzles may be stowed when not in use. The pump thus described is entirely conventional and will be well understood by those skilled in the art; the basic features of the pump will not be therefore described in further detail here.

Figure 2:
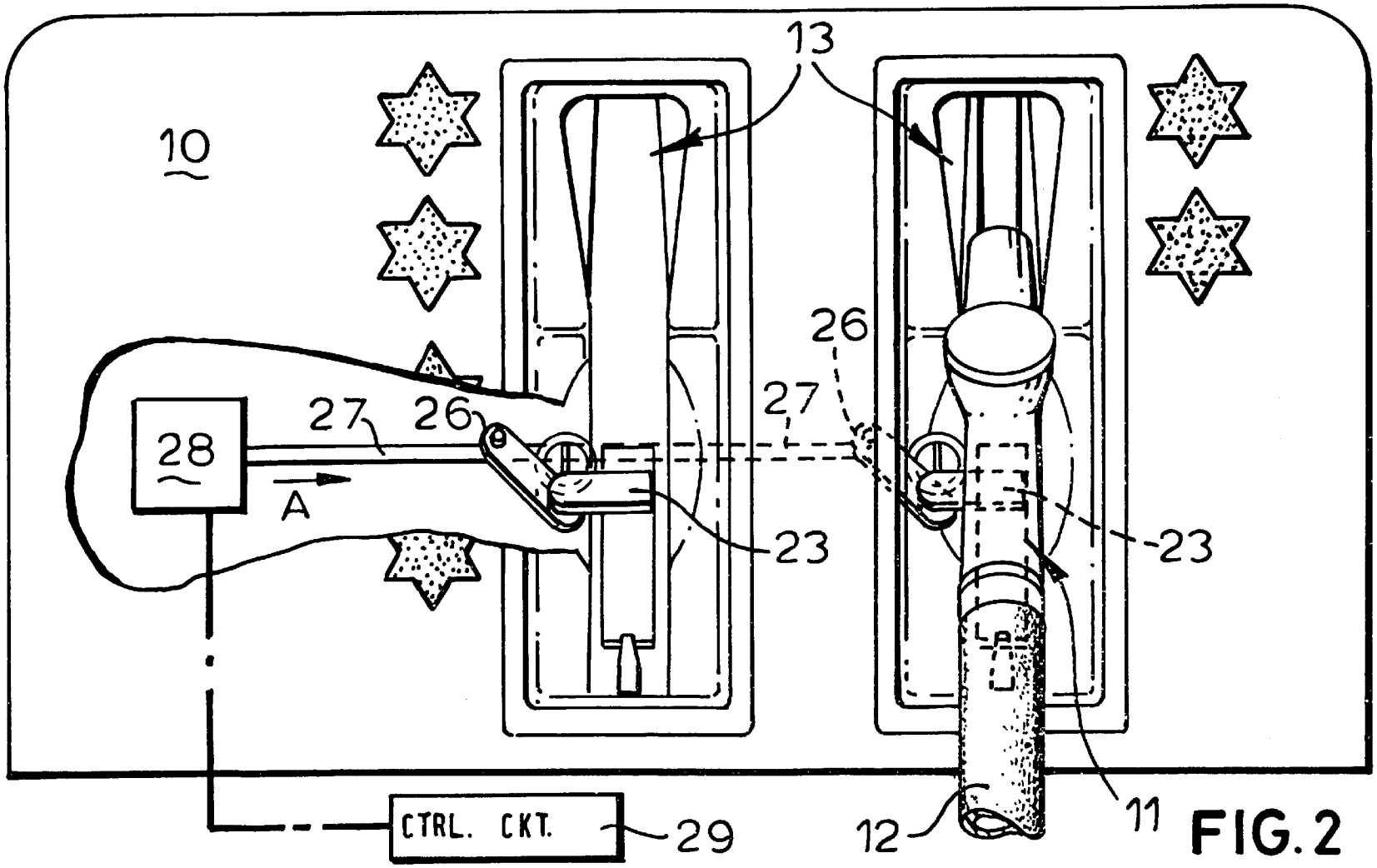
FIG. 2 is a side view of a part of the pump of FIG. 1.
Figure 3:
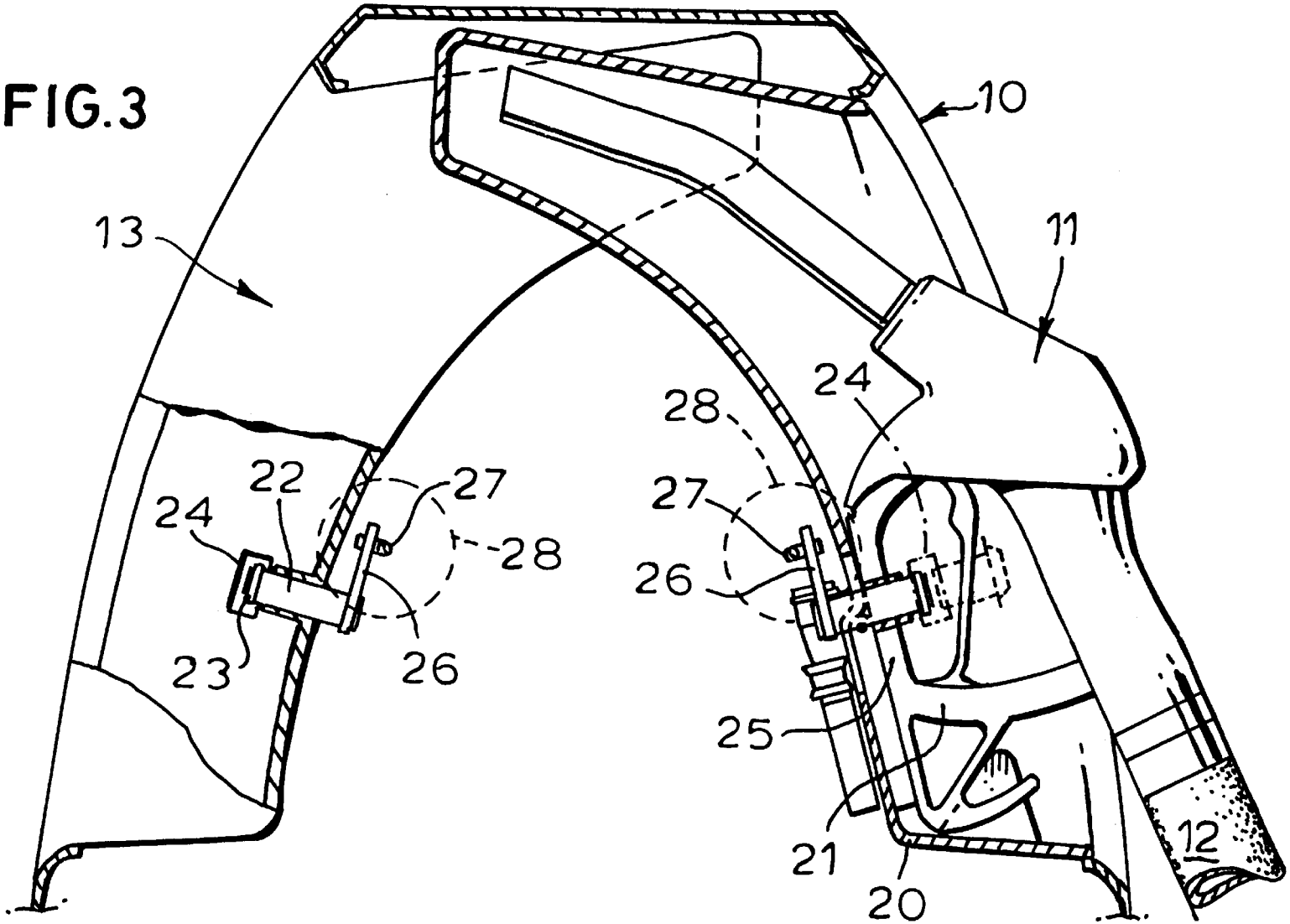
FIG. 3 is a vertical sectional view through an upper part of the pump of FIG. 1.

Referring now particularly to FIGS. 2 and 3 of the drawings, there is shown a remotely-controlled locking arrangement for the nozzles of the pump, whereby the respective nozzles may be locked in their associated holders. As shown in FIG. 3, each nozzle holder includes a frame 20 against which the handle portion 21 of a nozzle 11 engages. Mounted on frame 20 adjacent the region where the handle portion is located is a shaft 22 supporting an arm 23, arranged so that rotation of the shaft moves the arm 23 between a free position (not shown) to a locked position (FIG. 2) where the arm 23 projects through opening 24 in the region of the handle portion 21 of the nozzle. Thus, when in that locked position, the arm 23 prevents withdrawal of a nozzle 11 from its nozzle holder, by virtue of the interaction between the arm 23 and a guard 25 of the nozzle, for the dispensing trigger.

A crank 26 is also secured to the shaft 22, within the interior of the pump. That crank 26 is connected by a tie-rod 27 to an electromagnetic actuator 28. When appropriately energised, the actuator 28 moves the tie-rod 27 in the direction A marked on FIG. 2, so turning the shaft 22 through about 90°. From the position shown in FIG. 2, the rotation of the shaft is clockwise, so moving the arm 23 free of the nozzle in the holder.

As will be appreciated from FIG. 2, the pair of side by side nozzle holders each has a nozzle locking arrangement including a shaft 22 and an arm 23 as described above, the two cranks 26 being linked together by the same tie-rod 27, whereby both arms 23 are moved into and out of engagement with an associated nozzle, essentially simultaneously. A similar arrangement is provided on the opposite side of the pump, whereby operation of the two actuators simultaneously locks or releases all four nozzles.

As shown in FIG. 2, the actuators 28 may be operated by a remote switch arrangement 29, which may for example be located in a pay-booth or cashiers area. Equally, all other pumps on a forecourt may similarly be provided with a locking arrangement and the actuators thereof all operated essentially simultaneously.

A nozzle sensor (not shown) may be provided, in order to detect the presence of a nozzle, properly position within its holder. Such a nozzle detector may be coupled back to the control system, whereby operation of the associated actuator is inhibited in the event that no nozzle is detected as being present in any given holder. Moreover, a further detector for arm movement to its locking position may be provided, whereby an alarm signal may be generated in the event that a control signal has been provided to an actuator to cause movement of the associated arm to its locked position, and yet no signal is returned within some pre-determined period of time, indicating that the arm has so moved. This will enable an operator to check proper placement of a nozzle in its holder and then take such appropriate remedial action as may be necessary. In the event that there has been a failure in the system, such as non-operation of the actuator 28, then the operator may still lock the nozzle in position using a padlock in the conventional way.

I claim:

1. A forecourt fuel pump including a flexible delivery hose having a delivery nozzle at its free end and a holder for the nozzle, which pump further includes a locking member mounted on the pump and movable between a locked position where the locking member is engaged with the nozzle when in its holder and prevents the nozzle being removed therefrom and a free position where the nozzle is free of the locking member, a power-operated actuator for moving the locking member between its two positions, and control means for the power-operated actuator.

2. A forecourt fuel pump as claimed in claim 1, wherein the control means includes switch means for controlling the actuator, which switch means is remotely located with respect to the fuel pump.

3. A forecourt fuel pump as claimed in claim 1, wherein the control means controls operation of the actuator on one of an electrical, pneumatic or hydraulic basis.

4. A forecourt fuel pump as claimed in claim 1, wherein the locking member comprises a bar which in its locked position extends through an aperture formed in the nozzle.

5. A forecourt fuel pump as claimed in claim 4, wherein the locking member extends through a hand-hold aperture of the nozzle.

6. A forecourt fuel pump as claimed in claim 1, wherein the locking member is in the form of an arm mounted for rotational movement between free and locked positions.

7. A forecourt fuel pump as claimed in claim 1, wherein the actuator resists movement of the locking member other than when driven by the actuator.

8. A forecourt fuel pump as claimed in claim 1 wherein the actuator comprises a linear electro-magnetic actuator coupled to the locking member.

9. A forecourt fuel pump as claimed in claim 1 to 7, wherein the actuator comprises a motor having a rotary output, and a screw-threaded driving mechanism links the motor output shaft to the locking member.

10. A forecourt fuel pump as claimed in claim 1 and including more than one delivery hose, each such hose having a delivery nozzle and an associated holder therefor, there being a respective locking member associated with each of the holders and all of the locking members being operable by said actuator.

11. A forecourt fuel pump as claimed in claim 1, wherein the nozzle holder includes a detector for the presence of the nozzle therein, and means to inhibit operation of the actuator until the nozzle is detected as being present in the holder.

12. A forecourt fuel pump as claimed in claim 1, wherein the control means is arranged to detect movement of the locking member to its locked position following operation of the control means to effect operation of the actuator to cause such movement.

13. A forecourt layout including a plurality of fuel pumps as claimed in claim 1, wherein the control means includes a switch arrangement to cause essentially simultaneous operation of the power-operated actuators of all of the fuel pumps, to move all of the locking members of the pumps either to their free positions or to their locked positions.

14. A forecourt layout as claimed in claim 13, wherein the switch arrangement is located in a payment area for the forecourt, remote from the fuel pumps themselves.

15. A forecourt fuel pump including a flexible delivery hose having a delivery nozzle at its free end and a holder for the nozzle, which pump further includes a locking member mounted on the pump and movable between a locked position where the locking member is engaged with the nozzle when in its holder and prevents the nozzle being removed therefrom and a free position where the nozzle is free of the locking member, a power-operated actuator for moving the locking member between its two positions, and switch means for controlling the actuator, which switch means is remotely located with respect to the fuel pump, the locking means comprising a bar which in its locked position extends through an aperture formed in a part of the nozzle.

16. A forecourt fuel pump as claimed in claim 15 and including more than one delivery hose, each such hose having a delivery nozzle and an associated holder therefor, there being a respective locking member associated with each of the holders and all of the locking members being operable by said actuator.

* * * * *